US008651891B2

(12) United States Patent
Balfour et al.

(10) Patent No.: US 8,651,891 B2
(45) Date of Patent: Feb. 18, 2014

(54) HOT LINE CLAMP

(75) Inventors: William J. Balfour, Winsted, CT (US); Tom L. Ries, Ord, NE (US)

(73) Assignee: Electric Motion Company, Inc., Winsted, CT (US)

( * ) Notice: Subject to any disclaimer, the term of this patent is extended or adjusted under 35 U.S.C. 154(b) by 41 days.

(21) Appl. No.: 13/361,136

(22) Filed: Jan. 30, 2012

(65) Prior Publication Data

US 2013/0196557 A1 Aug. 1, 2013

(51) Int. Cl.
*H01R 13/00* (2006.01)

(52) U.S. Cl.
USPC ..... 439/479

(58) Field of Classification Search
USPC ..... 439/479, 477, 480, 803
See application file for complete search history.

(56) References Cited

U.S. PATENT DOCUMENTS 3,075,166 A * 1/1963 Peek ..... 439/479
3,142,525 A * 7/1964 Roosman ..... 439/479

* cited by examiner

*Primary Examiner* — Phuong Dinh
(74) *Attorney, Agent, or Firm* — Alix, Yale & Ristas, LLP

(57) ABSTRACT

A hot line clamp employs a pair of jaw members which have clamp surfaces. The jaw members are coupled under the load of a compression spring. One jaw member has a ring which allows for relative angular positioning so that a clamp surface of the jaw member engages a shoulder of the second jaw member in a cocked position. When a torque is applied to the ring, the clamp members snap together to clamp over a hot line disposed between the clamp surfaces.

16 Claims, 9 Drawing Sheets

HOT LINE CLAMP

BACKGROUND

This disclosure relates generally to hot line clamps which provide a conductor connector with a power line. More particularly, this disclosure relates to hot line clamps which employ a pair of cooperative jaw members to clamp against a hot line and implement a connection for a conductor.

In hot line clamps, to which the present disclosure relates, a pair of jaw members clamp against an overhead power line. A hot stick engages an eye bolt of the clamp and is employed for torquing and securing the cooperative jaws onto the power line. The upper jaw member may include an extension to guide the clamp onto the power line during installation. The clamp is typically loaded by a coil spring to compensate for temperature differentials, including cold flow, and to offset variations associated with the torquing of the eye bolt.

Hot line clamps are typically employed in overhead line operations at significant heights above the ground and require torquing from below by a hot stick. The hot stick, which typically has a fiberglass composition and extends several feet, is manipulated by the lineman from an elevated bucket at a distance from the hot line clamp installation. The repetitive installation of numerous such conventional clamps can result in significant stress on the body joints of the installer. Typically, several complete rotations are required to sufficiently load the jaws of conventional line clamps to adequately secure the hot line clamp in place.

SUMMARY

Briefly stated, a hot line clamp comprises a pair of axially and angularly positionable jaw members. A first jaw member forms a saddle defining a first clamp surface. The first jaw member has an upper portion with a spring bearing surface and an axial opening. A lower portion of the first jaw member has an engagement shoulder. The first jaw member also has a connector for a conductor. A retainer is configured to receive a conductor and is securable to the connector.

The second jaw member is coupled to the first jaw member and has an upper second clamp surface, an integral lower portion with a ring and includes a threaded opening. A bolt having a shank with a threaded end is engageable in the threaded opening of the second jaw member.

A spring carried by the bolt exerts a force against the spring bearing surface. The second jaw member is angularly positionable at a first cocked position so that the second clamped surface engages the engagement shoulder to form in cooperation with the first jaw member an open gap for a line. The first jaw member is angularly displaceable by a torque applied to the ring to a second angular clamped position wherein a line disposed in the gap is clampable between the first and second clamp surfaces under the force of the spring.

In one embodiment, the spring bearing surface is a surface defining a counterbore surrounding the axial opening of the first jaw. The first jaw has a forward downwardly inclined structure extending from the saddle. The first clamped surface has a generally elongated concave shape. The engagement shoulder is defined by a notch. The second jaw member comprises an anvil which upwardly terminates in the second clamped surface. The second jaw member further comprises a spine extending orthogonal to the anvil.

The retainer comprises a yoke having an opening for receiving the conductor. The connector is a laterally projecting boss which has a transverse opening with an enlarged retention slot. The retainer has a structure which is received in the opening and is engageable in the slot to prevent rotation.

The bolt has a head and the spring exerts a biasing force against the first clamp member and the head of the bolt. Both the first and second clamped surfaces preferably have a generally elongated concave shape.

A method for installing a conductor to a hot line comprises providing a clamp assembly angularly positionable between a cocked position and a clamped position. A conductor is connected to the clamp assembly. The clamp assembly is placed in a cocked position. The clamp assembly is installed over the hot line. A torque is applied to the clamp assembly to transfer the assembly to the clamped position. The assembly preferably comprises a ring and the step of torquing the clamp assembly comprises applying a torque to the ring.

DETAILED DESCRIPTION

Figure 1:
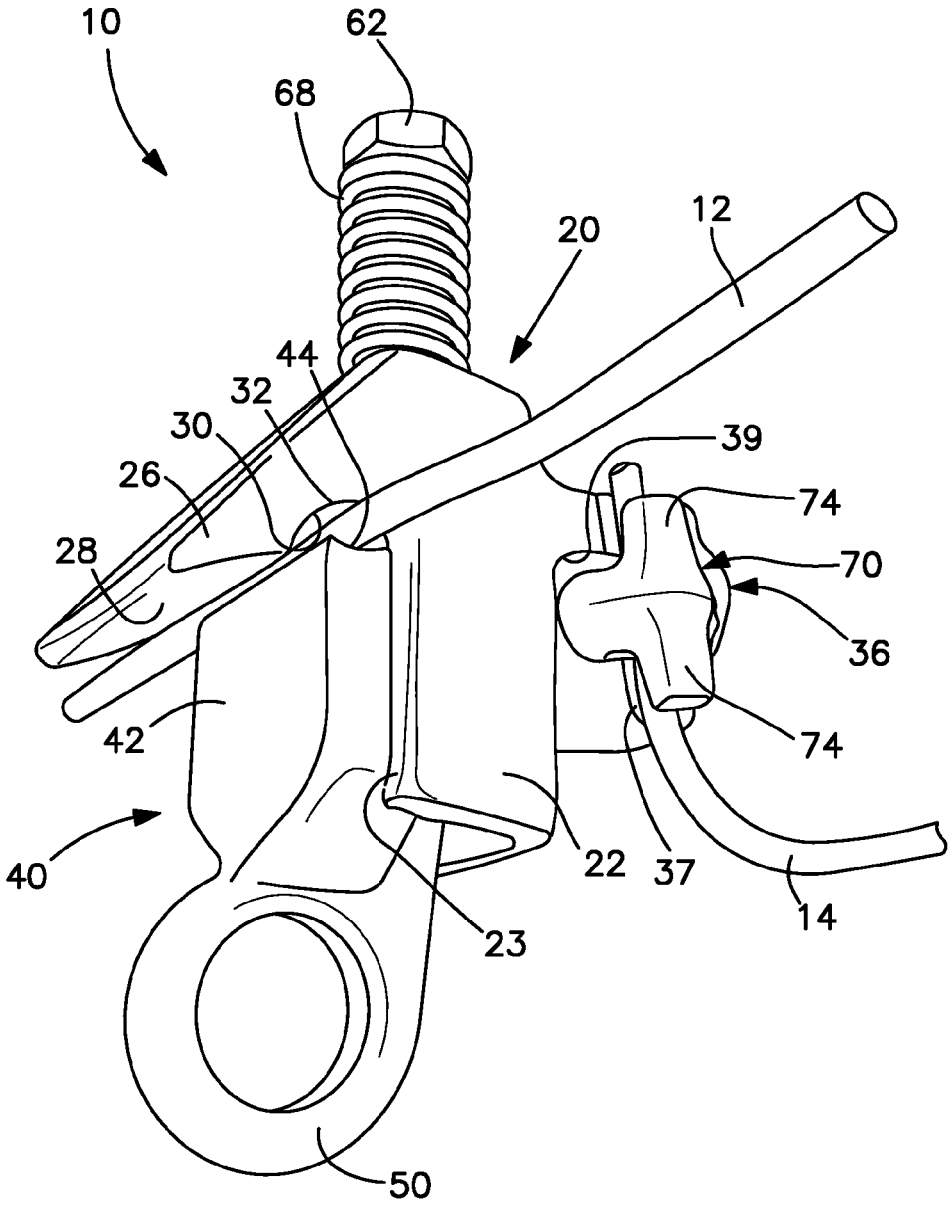
FIG. 1 is a perspective view of a hot line clamp as installed over a line (partially illustrated) and connected to a conductor (partially illustrated)

With reference to the drawings wherein like numerals represent like parts throughout the several Figures, a hot line clamp is generally designated by the numeral 10. The hot line clamp is adapted to ride on an active overhead wire 12 and connect with a conductor 14. Upon activation with a hot stick (not illustrated) operated by a lineman from below or at a distance, the hot line clamp is easily placed in a cocked position and positioned over and secured on the line to provide an active power line connection for a conductor.

The hot line clamp 10 comprises a pair of generally axially and angularly positionable jaw members 20 and 40 which, upon activation, cooperatively securably clamp an intermediately positioned hot line 12. The jaw members 20 and 40 are preferably bronze alloy or aluminum alloy castings.

Clamp member 20 is functionally an upper component which comprises a generally three-sided receiver 22 with frontal guide edges 23 forming an axial receiving channel with a top cap 24. An axial opening 25 with an upper counterbore 27 extends through the cap 24.

An inclined forward extension 26 integral with the cap 24 has an underside rounded surface that forms a saddle 30. The forward extension 26 of the jaw member terminates in a duck bill-like structure which has a lower tapered guide surface 28 extending outwardly from the saddle 30. The saddle 30 inwardly forms a transversely extending, arcuate or concave clamp surface 32.

A lower side skirt portion of the receiver 22 has a notch forming a transverse engagement shoulder 34. The jaw member 20 integrally rearwardly has a robust projecting boss 36 which defines a transverse opening 38 with an enlarged oval slot 39 at one side. The boss 36 preferably has a rearward rounded terminus and a semi-flat surface 37 adjacent to the slot 39.

The second functionally lower jaw member 40 forms a base and functions to move axially and angularly relative to jaw member 20. Jaw member 40 comprises an upwardly projecting anvil 42. Jaw member 40 is configured to be axially slidable in the receiving channel of the receiver 22 with the anvil 42 sliding along the forward edges 23 of the receiver 22. The anvil at an upper portion thereof has a shallow elongated concave surface which functions as a line clamp surface 44.

The lower portion of the base comprises an integral ring 50 with an integral upward rearwardly protruding support spine 52. The anvil 42 is generally orthogonal to the ring 50 and the spine 52. The anvil 42, eyelet 50 and spine 52 are dimensioned and configured so that the anvil 42 can be slidably axially received along a path exterior of the receiving channel and alignable with the clamp surface 32, as well as a cocked offset non-aligned position described below. In the aligned position, the anvil clamp surface 44 is disposed opposite the clamp surface 32 of the first jaw member with the spine 52 being slidably received within the receiver 22 of the first member 20. A threaded axial bore 54 opens through an upper portion of the jaw member 40.

A bolt 60 with a hex head 62 has a shank 64 with a threaded end 66. The bolt shank receives a high compression spring 68. The bolt axially extends through the axial opening 25 of the first jaw member and is threaded into the bore 54 of the lower jaw member to essentially couple together the jaw members 20 and 40. The spring 68 is captured and tensioned between an upper surface of the upper jaw member counterbore 27 and the head 62 of the bolt. The bolt 60 thus functions to couple the jaw members under a load which urges the jaw members clamping surfaces 32 and 44 together and into a clamping relationship (with the intermediately disposed power line).

A yoke 70 for retaining the conductor 14 preferably has an opening 72 with adjacent integral retaining wings 74 and a threaded shank 76. The conductor 14 is passed through the opening and the shank is inserted into the transverse opening 38 of the upper jaw member. The yoke is secured by a nut 80 and a lock washer 82 to thereby clamp the conductor against the surface 37 of the connector boss of the first jaw member. Portions of the yoke 70 are retained by the walls of the retention slot 39 to prevent rotation about the axis of the shank 76.

Figure 2:
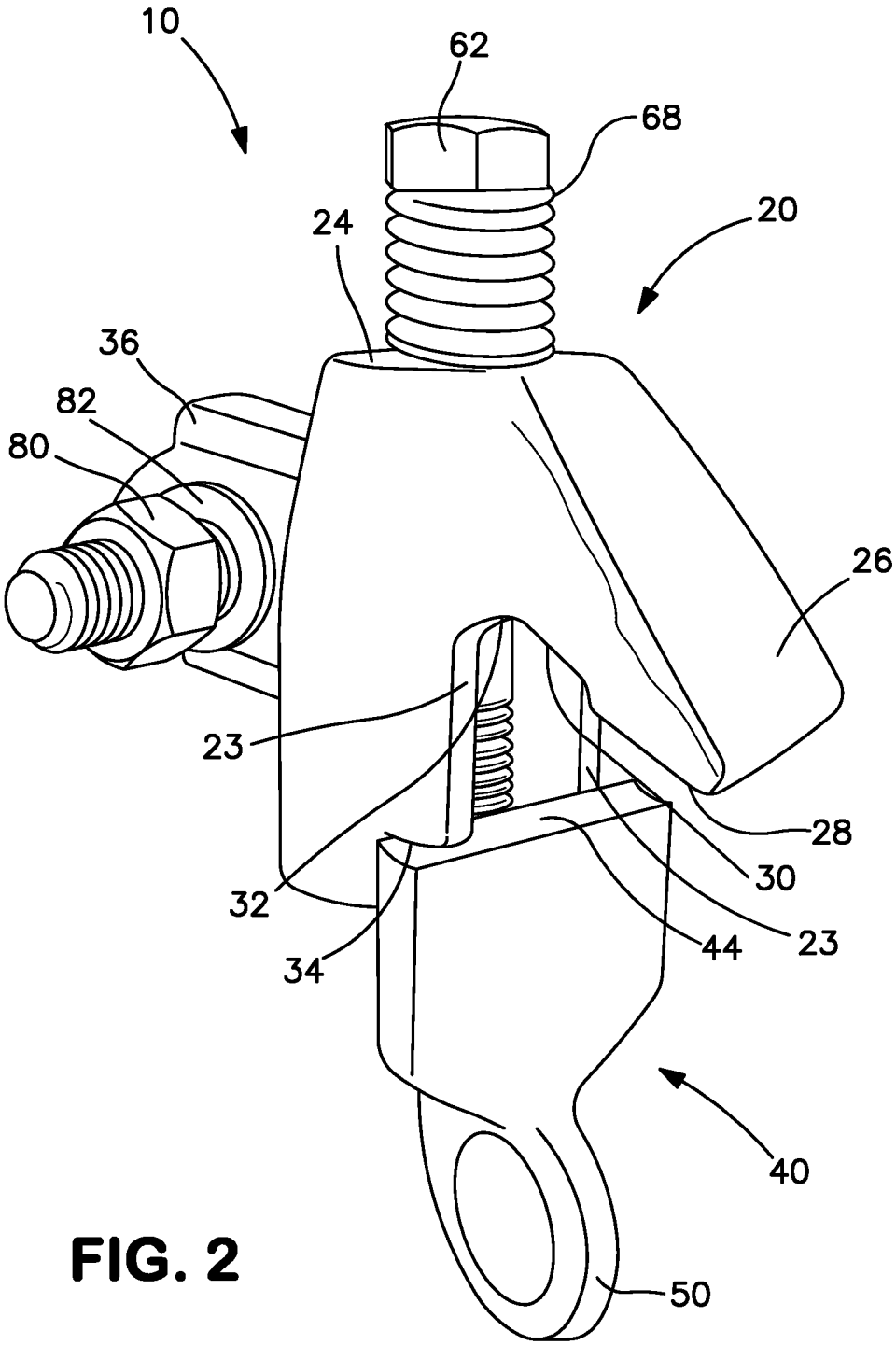
FIG. 2 is a perspective view of the hot line clamp of FIG. 1 in a pre-installation cocked position.
Figure 3:
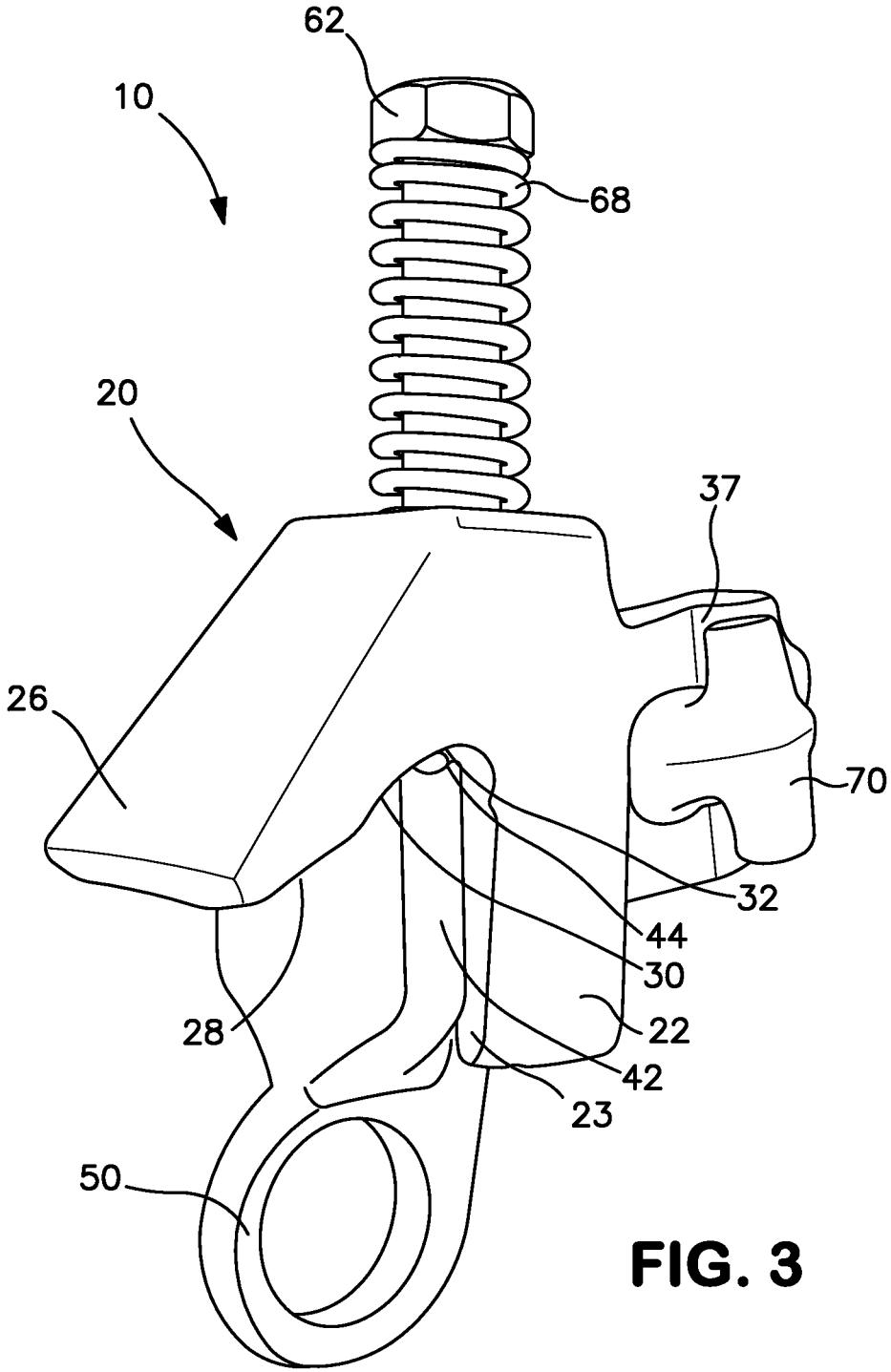
FIG. 3 is a perspective view of the hot line clamp of FIG. 1 illustrated in a clamped position.
Figure 4:
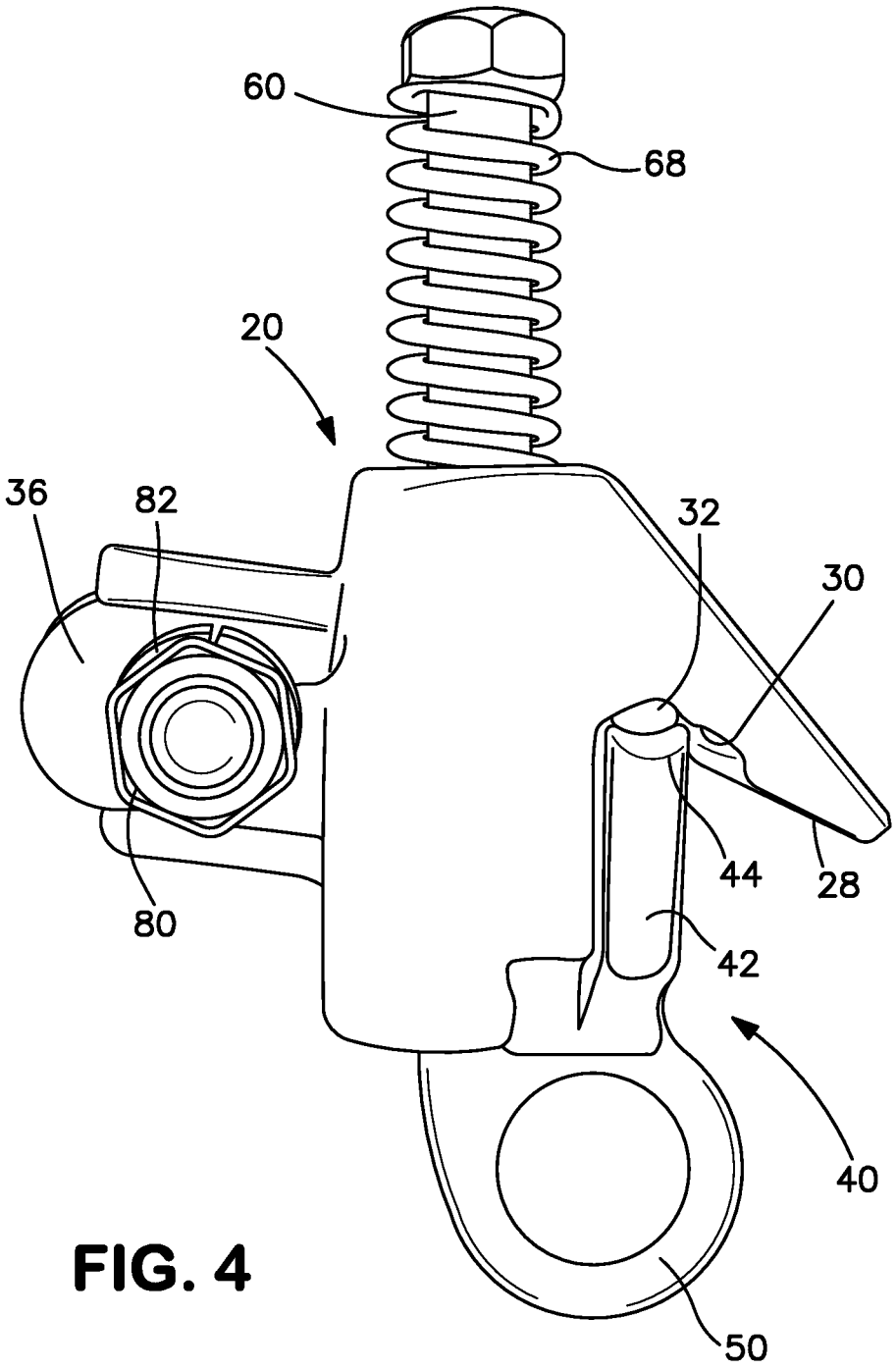
FIG. 4 is a side elevational view of the hot line clamp of FIG. 3 from generally the opposite side thereof.
Figure 5:
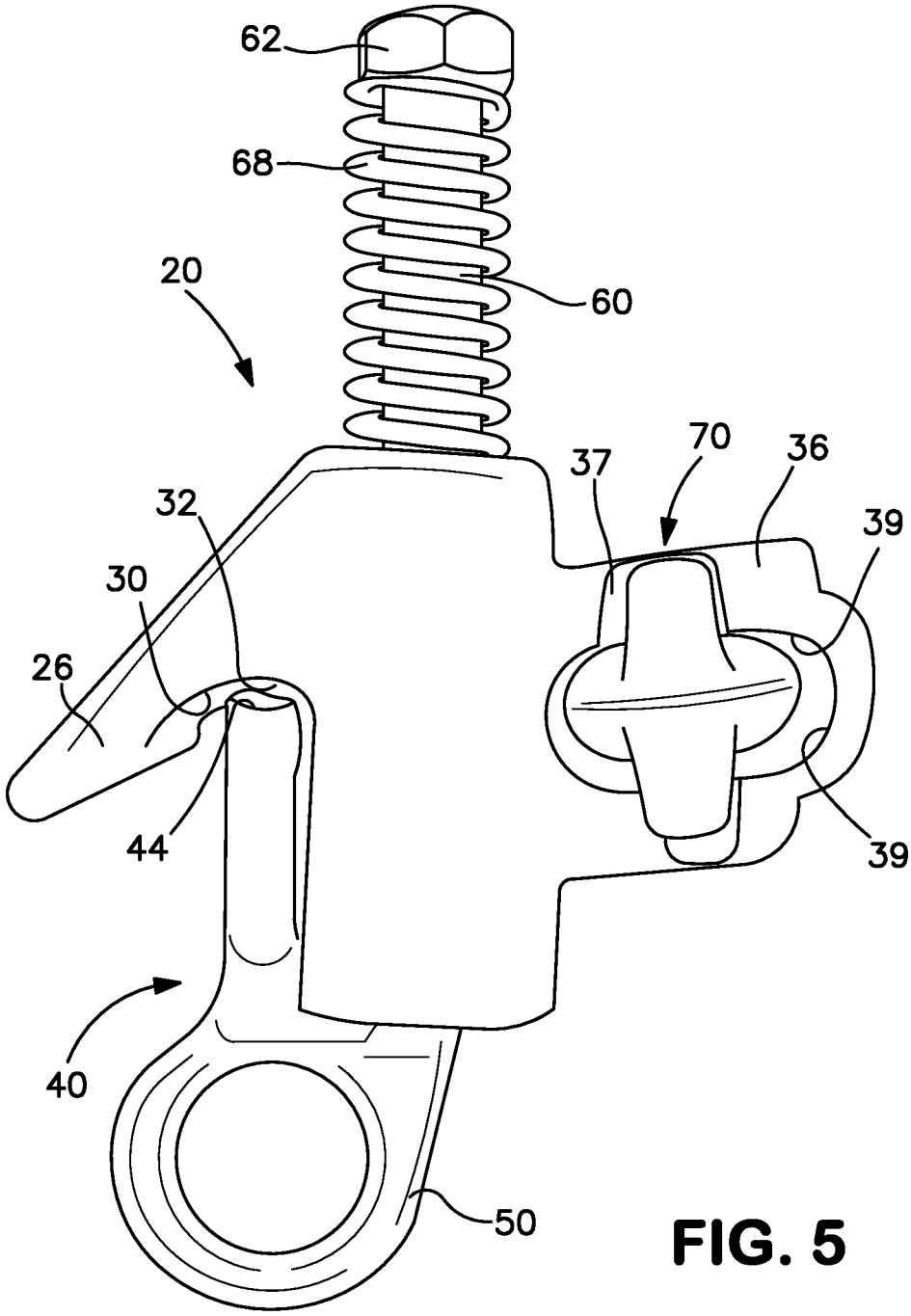
FIG. 5 is a side elevational view of the hot line clamp of FIG. 4 taken from the opposite side thereof.
Figure 6:
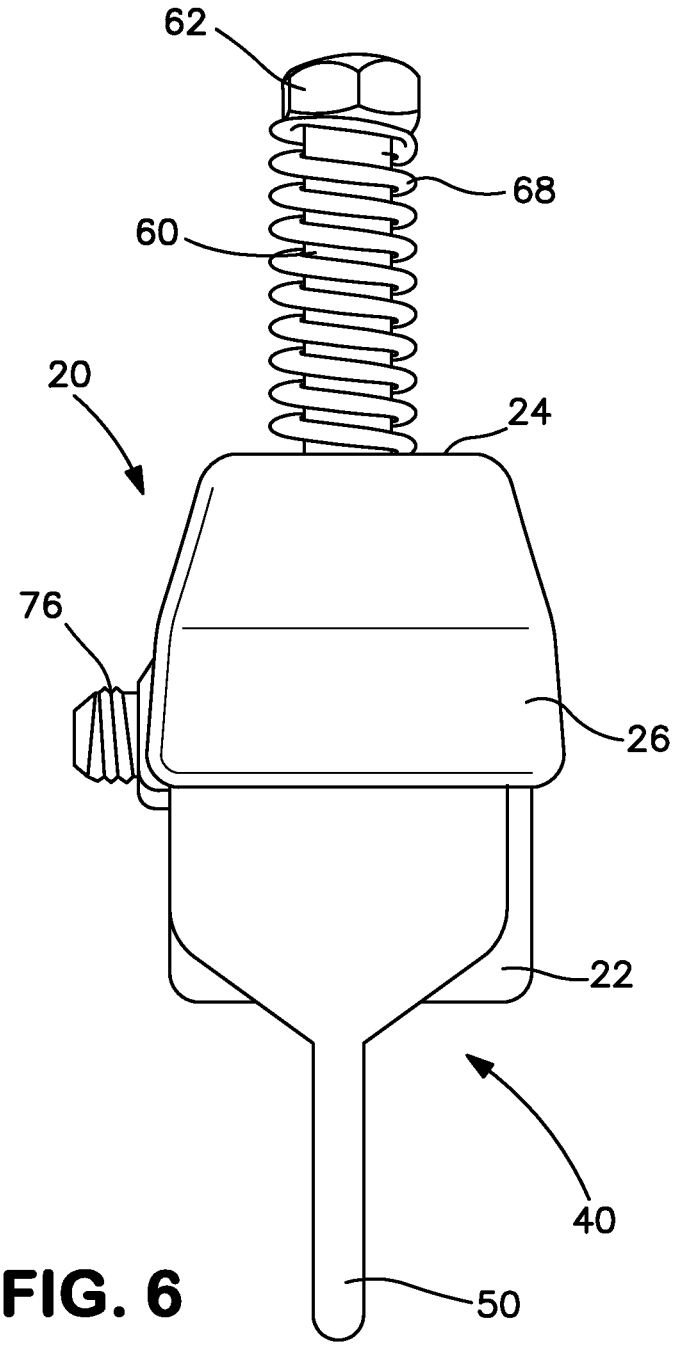
FIG. 6 is a front elevational view of the hot line clamp of FIG. 1 in a clamped position.
Figure 7:
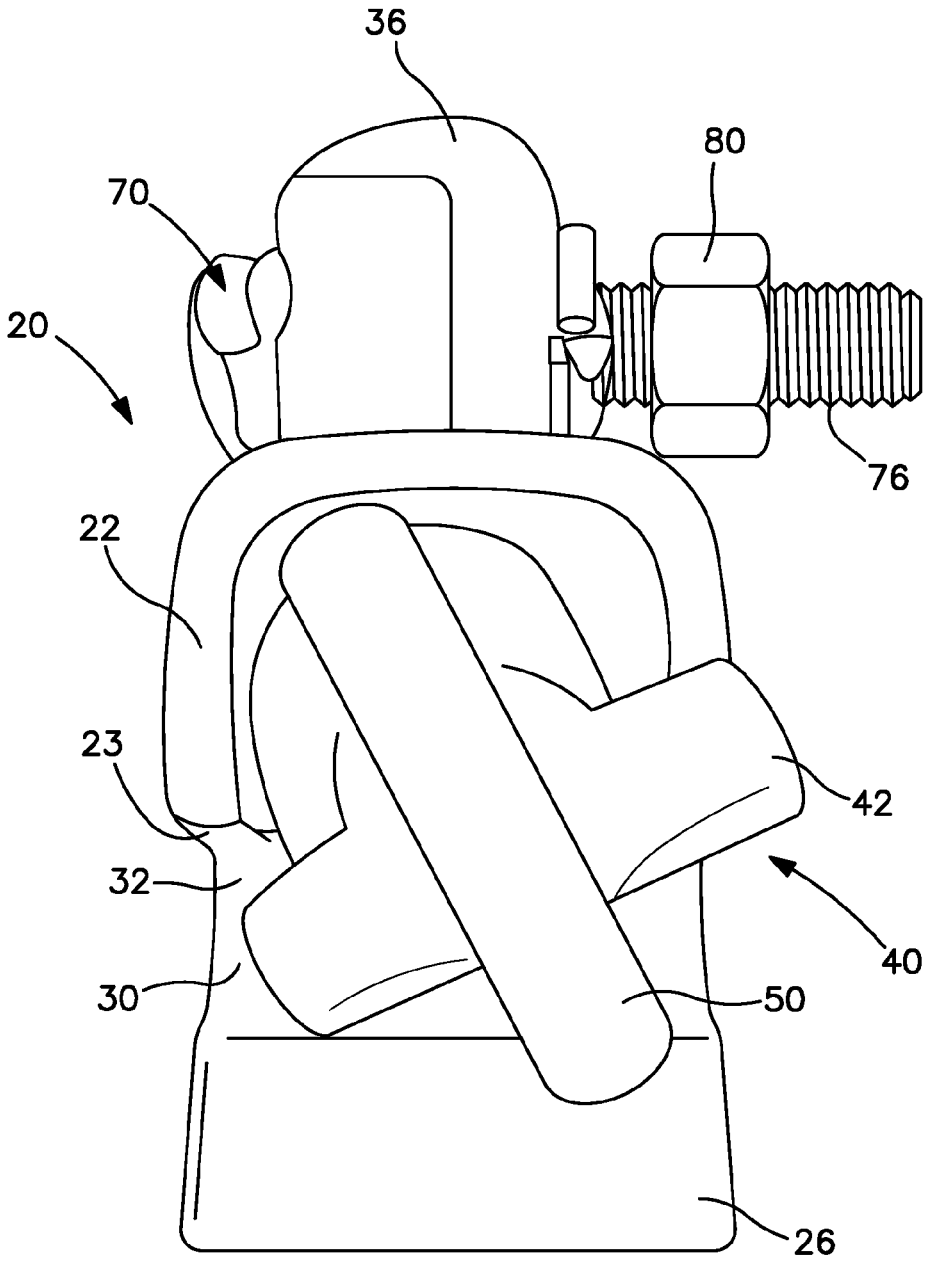
FIG. 7 is a bottom plan view of the hot line clamp of FIG. 1 illustrated in a pre-installation cocked position.
Figure 8:
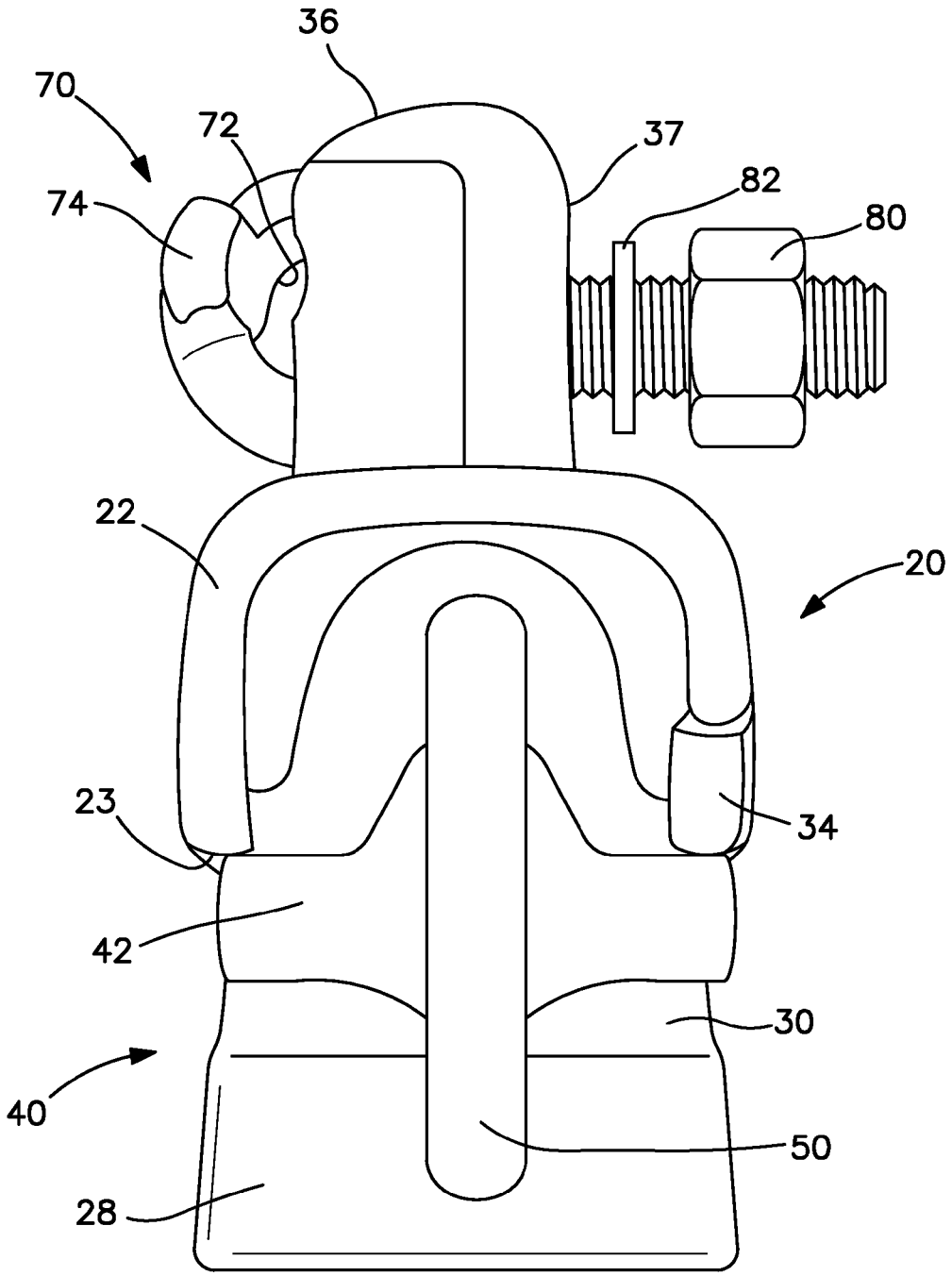
FIG. 8 is a bottom plan view of the hot line clamp of FIG. 1 in a clamped position.
Figure 9:
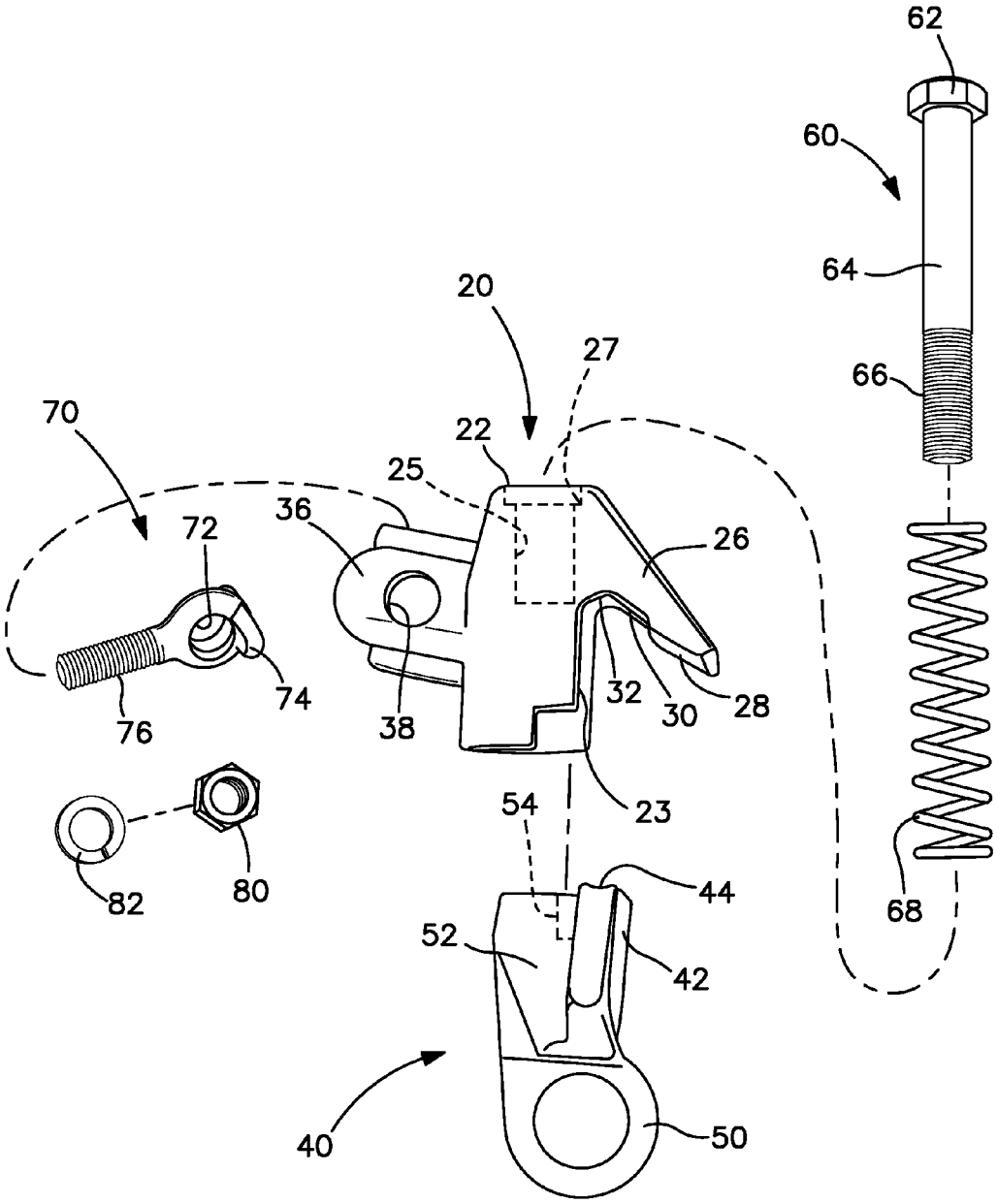
FIG. 9 is an exploded view, portions in phantom, of the hot line clamp of FIG. 1.

For installation, the conductor 14 is securely connected in place by the connector yoke 70. The lower jaw member 40 is pulled apart from the upper jaw member 20 against the bias force of the spring 68 via a force applied to the ring 50 and moved axially until the clamp surface 44 moves beyond the retainer shoulder 34. The lower jaw member 40 is pivoted about the axis of the bolt 60 so that the upper surface of the anvil 42 engages the underside of the shoulder 34 as illustrated, for example, in FIG. 2. The foregoing opening and pivoting of the clamp assembly can be easily and efficiently accomplished by means of a hot stick with the engagement tool end engaging the ring 50. This cocked position is maintained under the high force of the spring 68.

In the cocked position, the saddle 30 and the clamp surfaces 32 and 42 are in an opened position to provide a gap so that the upper jaw 20 may easily saddle over the hot line. The lower guide surface 28 aids in guiding the upper jaw member 20 over and toward the hot line so that the clamp surface 32 moves across and over the hot line to a relatively stable position supported on the hot line.

The engagement tool end of the hot stick is engaged with the ring 50 and a torque is applied for a small angular distance so that the anvil surface 42 angularly clears the engagement shoulder 34. The clamp surface 44 then snaps toward the upper clamp surface 32 with the back on the anvil 42 sliding along the channel edges 23, thereby capturing and clamping the hot line. The torque angle is typically only a few degrees and is preferably significantly less than 45°. The spring 68 secures the hot line in the clamped position between the elongated transverse clamp surfaces 32 and 44 so that a connected conductor electrically conductively connects the hot line.

It will be appreciated that a relatively small torque angle is required to activate the clamp to forcefully clamp onto the received hot line. Once clamped, additional torquing is not required. A durable and reliable clamp engagement is ensured by the load of the spring 68.

While preferred embodiments have been set forth for purposes of description, the foregoing description should not be deemed a limitation of the invention herein. Accordingly, various modifications, adaptations and alternatives may occur to one skilled in the art without departing from the spirit and the scope of the present invention.

The invention claimed is:

1. A hot line clamp comprising:

a first jaw member defining a first clamp surface and having an upper portion defining a spring bearing surface and an axial opening, a lower portion having an engagement shoulder, and a conductor connector;

a second jaw member coupled to said first jaw member and having an upper second clamp surface, an integral lower portion with a ring and defining a threaded opening;

a retainer configured to receive a conductor and securable to said connector;

a bolt having a shank with a threaded end and engageable in said threaded opening of said second jaw member; and a spring carried by said bolt and exerting a force against said spring bearing surface, wherein said second jaw member is angularly positionable at a first cocked position so that said second clamp surface engages said engagement shoulder to form in cooperation with said first jaw member an open gap for a line, and said first jaw member is angularly displaceable by a torque applied to said ring to a second angular clamped position wherein a line is clampable between said first and second clamp surfaces under the force of said spring.

2. The hot line clamp of claim 1 wherein said spring bearing surface is a surface defining a counterbore surrounding said axial opening.

3. The hot line clamp of claim 1 wherein said first jaw member forms a saddle and has a forward downwardly inclined structure extending from said saddle.

4. The hot line clamp of claim 1 wherein said first clamp surface has a generally elongated concave shape.

5. The hot line clamp of claim 1 wherein said engagement shoulder is defined by a notch.

6. The hot line clamp of claim 1 wherein said second jaw member further comprises an anvil which upwardly terminates in said second clamp surface.

7. The hot line clamp of claim 5 wherein said second jaw member further comprises a spine extending generally orthogonally to said anvil.

8. The hot line clamp of claim 1 wherein said retainer comprises a yoke defining an opening for receiving the conductor.

9. The hot line clamp of claim 1 wherein said connector is an integrally projecting boss which defines a transverse opening having an enlarged slot and said retainer has a structure which is received in said slot and is engageable in said slot to prevent rotation.

10. The hot line clamp of claim 1 wherein said first cocked position of said second jaw member and said second clamped position of said second jaw member are disposed at an angular distance less than 45°.

11. A hot line clamp comprising:

a first jaw member having a first clamp surface, a receiver having an engagement shoulder, and a conductor connector;

a second jaw member received in said receiver and coupled to said first jaw member and having a second clamp surface and an integral lower portion defining an aperture, a connecting assembly connecting said first jaw member and said second jaw member and biasing said first clamp surface toward said second clamp surface, said connecting assembly comprises a connecting member having a head and extending through said first jaw member and secured to said second jaw member and carrying a spring compressed to exert a biasing force between the first jaw member and the head of the connecting member;

wherein said second jaw member is angularly positionable at a first cocked position so that said second clamp surface engages said engagement shoulder to form in cooperation with said first jaw member an open gap for a line, and said first jaw member is angularly displaceable by a torque applied to said lower portion adjacent said aperture to a second angular clamped position wherein said second clamp surface disengages said engagement shoulder and a line disposed in said gap is clamped between said first and second clamp surfaces.

12. The hot line clamp of claim 11 wherein said first jaw member defines a saddle and has a forward downwardly inclined structure extending from said saddle.

13. The hot line clamp of claim 11 wherein said first clamp surface and said second clamp surface each has a generally elongated recessed shape.

14. The hot line clamp of claim 11 wherein said engagement shoulder is defined by a notch.

15. The hot line clamp of claim 11 wherein said second jaw member further comprises an anvil which upwardly terminates in said second clamp surface and said second jaw member further comprises a spine extending generally orthogonally to said anvil and received by said first jaw member.

16. The hot line clamp of claim 11 wherein said connector is a laterally projecting boss which defines a transverse opening having an enlarged throat and a retainer comprises a yoke defining an opening for receiving the conductor and received in said transverse opening and secured to said connector.

* * * * *